US007861956B2

(12) United States Patent
Hiller, Sr.

(10) Patent No.: US 7,861,956 B2
(45) Date of Patent: Jan. 4, 2011

(54) APPARATUS AND METHOD FOR CRUSHING ANODES

(76) Inventor: Wesley T. Hiller, Sr., 9910 Chris Craft Ct., Tampa, FL (US) 33615

( * ) Notice: Subject to any disclaimer, the term of this patent is extended or adjusted under 35 U.S.C. 154(b) by 1 day.

(21) Appl. No.: 12/221,469

(22) Filed: Jul. 31, 2008

(65) Prior Publication Data

US 2009/0039185 A1 Feb. 12, 2009

Related U.S. Application Data

(60) Provisional application No. 60/964,166, filed on Aug. 8, 2007.

(51) Int. Cl.
*B02C 25/00* (2006.01)

(52) U.S. Cl. ..... 241/30; 241/263; 241/270

(58) Field of Classification Search ..... 241/36, 241/30, 262, 263, 270, 265; 100/52
See application file for complete search history.

(56) References Cited

U.S. PATENT DOCUMENTS

| | | | | | |
|---|---|---|---|---|---|
| 788,429 | A * | 4/1905 | Ruf | 241/94 |
| 3,708,128 | A | 1/1973 | Limpinsel et al. | |
| 3,771,437 | A * | 11/1973 | Brucken | 100/52 |
| 3,785,278 | A * | 1/1974 | Hopkins | 100/51 |
| 3,822,638 | A * | 7/1974 | Merkin | 100/52 |
| 3,884,422 | A * | 5/1975 | Weichel | 241/279 |
| 3,910,775 | A * | 10/1975 | Jackman | 44/589 |
| 3,941,046 | A * | 3/1976 | Smith | 100/45 |
| 3,995,672 | A * | 12/1976 | Binninger | 144/195.1 |
| RE29,278 | E * | 6/1977 | Vogel | 100/52 |
| 4,363,184 | A * | 12/1982 | Marcolina | 43/85 |
| 4,776,524 | A * | 10/1988 | Sakato | 241/101.73 |
| 5,123,339 | A * | 6/1992 | Hetherington | 100/52 |
| 6,145,768 | A * | 11/2000 | Okuya | 241/265 |
| 6,827,301 | B1 * | 12/2004 | Kassuba | 241/37 |
| 7,086,620 | B2 * | 8/2006 | Okuya | 241/264 |
| 7,219,601 | B2 * | 5/2007 | Tanaka | 100/193 |
| 2008/0168660 | A1 * | 7/2008 | Chiu | 30/114 |

* cited by examiner

*Primary Examiner*—Bena Miller
(74) *Attorney, Agent, or Firm*—Carter, Schnedler & Warnock

(57) ABSTRACT

There is provided an apparatus for crushing anodes, including a chamber for receiving the anodes. At least one movable wall is received in the chamber. The wall has a plurality of cutting devices associated therewith. The wall is able to move in a first direction for crushing the anodes and in a second direction away from the anodes. An apparatus is provided for applying pressure to the wall for moving the wall in the first direction. At least one pressure sensor associated with the apparatus for applying the pressure is provided. When a predetermined pressure level is reached, the wall ceases moving in the first direction and begins moving in the second direction.

33 Claims, 7 Drawing Sheets

APPARATUS AND METHOD FOR CRUSHING ANODES

CROSS-REFERENCE TO RELATED PATENT APPLICATIONS

This is a U.S. non-provisional application relating to and claiming the benefit of U.S. Provisional Patent Application Ser. No. 60/964,166, filed Aug. 8, 2007. The entire disclosure set forth in that provisional patent application is hereby incorporated herein by reference.

BACKGROUND

The present invention relates to an apparatus and method for recovering carbon from anodes and particularly for recovering carbon from anodes or remnants of anodes of the type used in the production of aluminum. When used herein, the term "anodes" means complete anodes, remnants of anodes and portions of anodes. Aluminum producers use large anodes in connection with the reduction of aluminum oxide to aluminum metal. These anodes are primarily made of carbon with metal conductors embedded therein. After a certain time of use in connection with the production of aluminum, these carbon anodes become less efficient and must be replaced. However, there is a substantial market for the carbon in these spent anodes. In order to provide a useful product, these carbon anodes must be crushed into smaller pieces. An example of an apparatus for salvaging carbon from spent anodes is disclosed in U.S. Pat. No. 3,708,128 issued to Limpinsel et al.

One of the problems associated with many prior art anode crushers is that the crusher can become damaged and worn because of impact with the metal components embedded in the carbon or impact with so-called hard anodes which were over-baked during their production. In addition, some prior art anode crushers consume a great deal of energy during operation. It is desirable for an anode crusher to operate at minimal velocity to minimize wear and tear and to prevent substantial dusting and to provide minimal generation of fines. It is also desirable to be able to control the pressure to prevent the anode crusher from attempting to crush items such as metal or hard anodes which can further damage the crusher.

SUMMARY OF THE INVENTION

In accordance with one form of this invention, there is provided an apparatus for crushing anodes, including a chamber for receiving anodes. At least one movable wall is received in the chamber. The wall has a plurality of cutting devices associated therewith. The wall is able to move in a first direction for crushing the anodes received in the chamber and in a second direction away from the anodes. An apparatus is provided for applying pressure to the wall for moving the wall in the first direction. At least one pressure sensor associated with the apparatus for applying pressure is provided. When a predetermined pressure level is exceeded, the wall ceases moving in the first direction and begins moving in the second direction.

In accordance with another form of this invention, there is provided a method for crushing anodes. The method includes placing anodes in a chamber having at least one movable wall and a bottom grate, applying pressure to the wall thereby moving the wall toward the anodes, crushing the anodes with cutting devices which are attached to the wall, sensing a pressure above a predetermined level, and moving the wall away from the anodes in response to the pressure being above the predetermined level.

DESCRIPTION OF THE PREFERRED EMBODIMENTS

Referring now more particularly to FIGS. 1-5, anode crushing apparatus 10 includes a rectangular chamber 12 which is open at the top to accept anodes in the form of large mineral lumps up to 60 inches in width, depth, and height in size with the objective of size reduction (crushing) of the mineral lumps to a smaller size for (A) a specific market need or (B) as a feed stock for secondary crushing by alternative means of crushing. An example of such a mineral lump is partial anode 14 shown in FIG. 6. In part, the crushing apparatus 10 is unique in that two major operational features of the apparatus are controlled for the specific material to be crushed. The first major operational feature relates to the pressure of the system when contacting the mineral lumps to accomplish the size reduction. The second major operational feature relates to the speed of travel of the two moving walls in the chamber, which will be described below.

Figure 6:
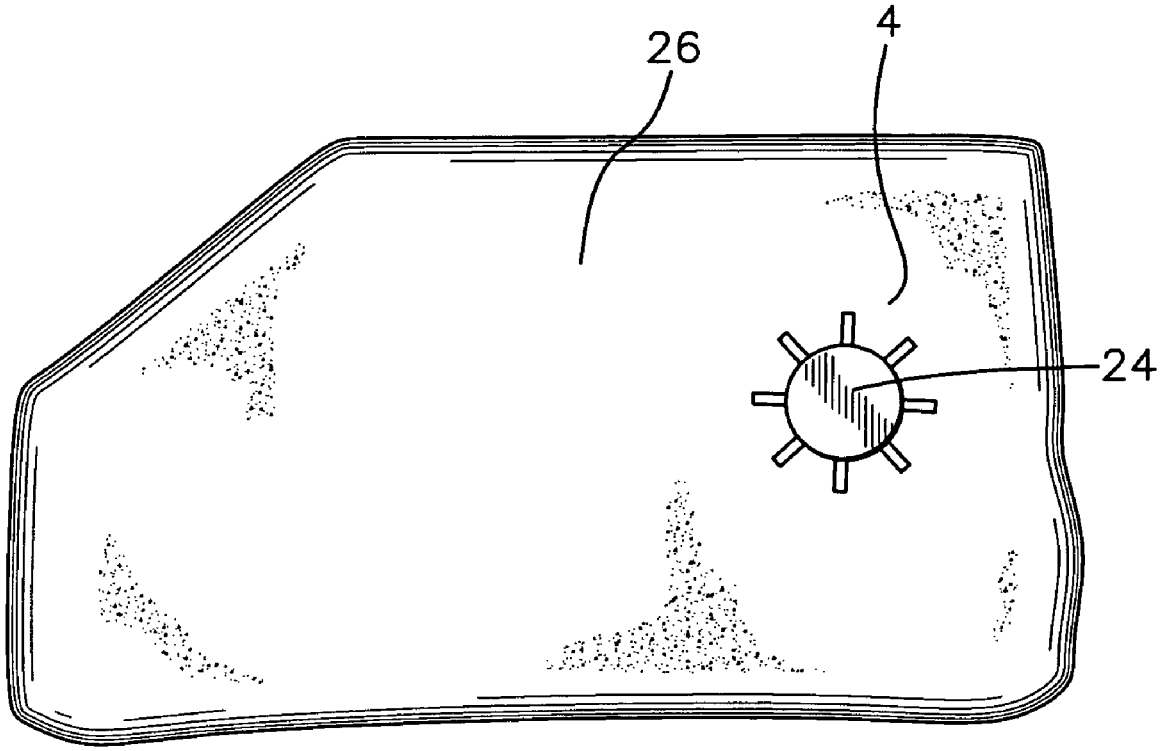
FIG. 6 shows a piece of anode material which may be crushed utilizing the apparatus of FIG. 1.

The anodes or minerals 14 are placed into the chamber 12 between a first movable wall 16 within chamber 12 on the right side of chamber 12 and a second movable wall 18 within chamber 12 on the left side of chamber 12. The movable walls are propelled towards each other using hydraulic cylinders 20 and 22 that function at an adjustable pressure (pounds per square inch) based upon the compressive strength of the mineral to break. The hydraulic cylinders 20 and 22 apply pressure or force to movable walls 16 and 18. As used herein in reference to moving the movable walls 16 and 18, the term "pressure" means force and pressure. The pressure is set to crush the specific mineral and at the same time not crush hard overbaked anode material or foreign objects such as ferrous and nonferrous metal that may be attached to or a part of the feed material coming into the apparatus. For example, FIG. 6 shows metal piece 24 embedded in carbon material 26. The movable walls 16 and 18 have cutting devices 28 attached to them that are of staggered lengths based upon the mounting arrangement of the cutting devices 28 on each movable wall. The staggered cutting devices allow more pounds per square inch of pressure to be exerted on the mineral lump or lumps in chamber 12 at any given time to allow less contact area on the lump for a given force which translates to a higher pressure on the mineral. The cutting devices 30 that are recessed behind the most forward cutting devices 32 come in contact with the lump after the initial contact of the most forward cutting devices 32 which are followed by a third and fourth tier of cutting devices also to optimize the transfer of pressure into the mineral lump for a given force. The pressure threshold is established to crush the target mineral or minerals and not to crush harder or extraneous material such as metal or hard anode material. Hydraulic pressure increases when the cutting devices 28 come in contact with hard or metal material.

The velocity of a moving wall is a function of the flow rate of hydraulic fluid through the cylinders 20 and 22 that is also adjustable. The more flow through the hydraulic cylinders, the higher the impact velocity of the moving walls 16 and 18 as they contact the anode 14. This allows infinite control of impact which along with the pressure is another key element of anode size reduction. As will be explained in more detail below, a sensor or sensors associated with the hydraulic cylinders 20 and 22 monitor pressure and flow in the crusher 10. When a pressure is sensed at a level above the point necessary to break the anode, the hydraulic system sends hydraulic fluid back to a reservoir from a power pack that provides energy into the crusher 10. As will be noted below, this pressure is adjustable by means of a bypass valve diverting hydraulic fluid. The movable walls 16 and 18 continue to move towards each other until this pressure is reached and when the maximum desired pressure is reached, the walls are retracted via a joy stick control to allow the material crushed in that cycle to drop down through a grate 34 in the bottom 36 of the chamber 12 into a collection area or transfer device such as a conveyor. When the walls retract (typically 6 to 12 inches), the pressure drops below the desired set point and the process can start again on the remaining anodes in the chamber until the walls 16 and 18 effectively meet at which time the walls retract to the fully open position to accept more feed material. Two items that determine the size of the crushed material are the size of the apertures 38 of the grate 34 and the spacing of the cutting devices 28. The closer the spacing of the cutting devices 28 and the smaller the apertures 38 in the grate 34, the finer the product coming from the crusher 10. These dimensions can be varied based upon size objectives of the material discharged.

Figure 1:
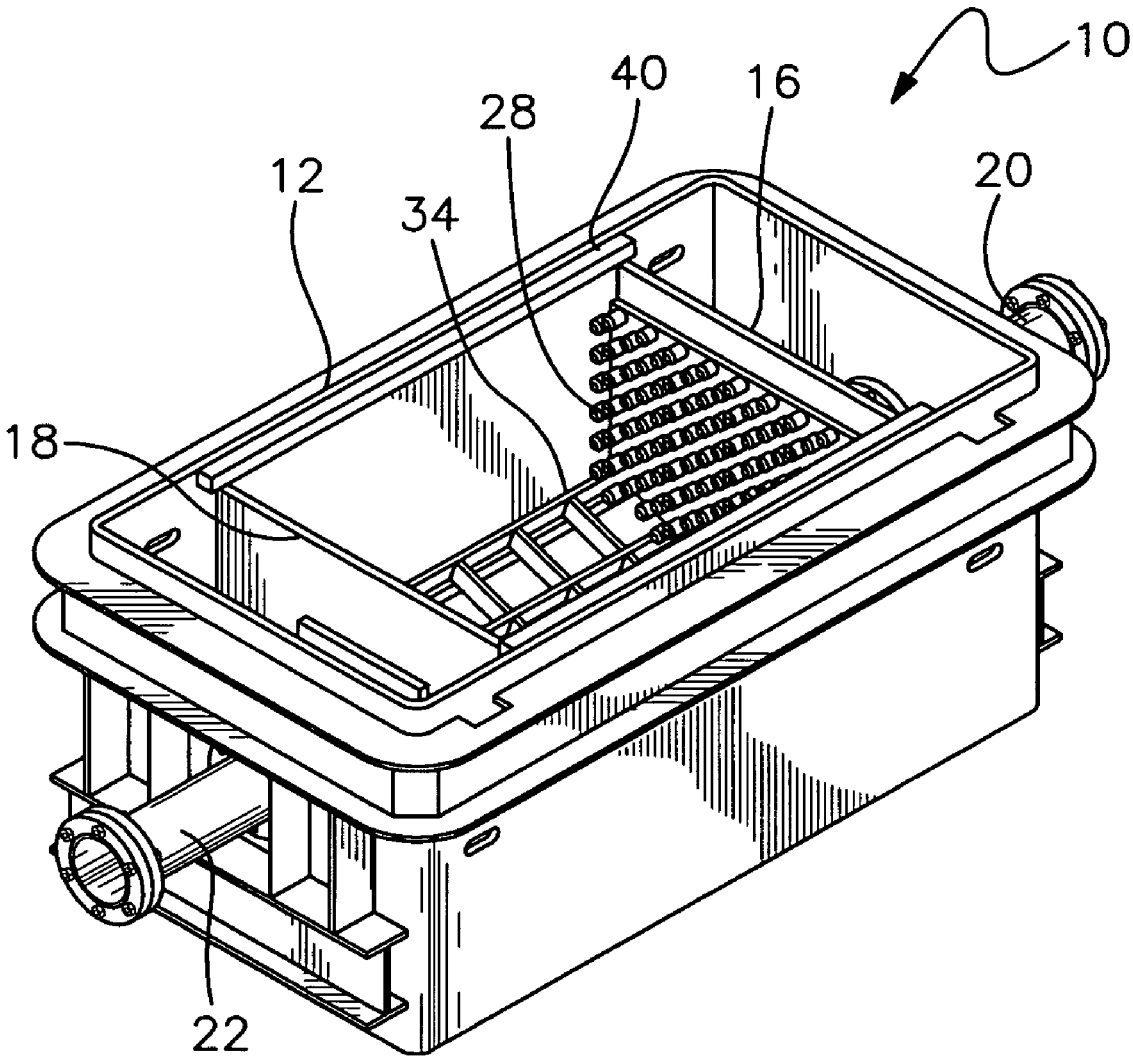
FIG. 1 is a perspective view of an anode crusher apparatus in accordance with one form of this invention.
Figure 2:
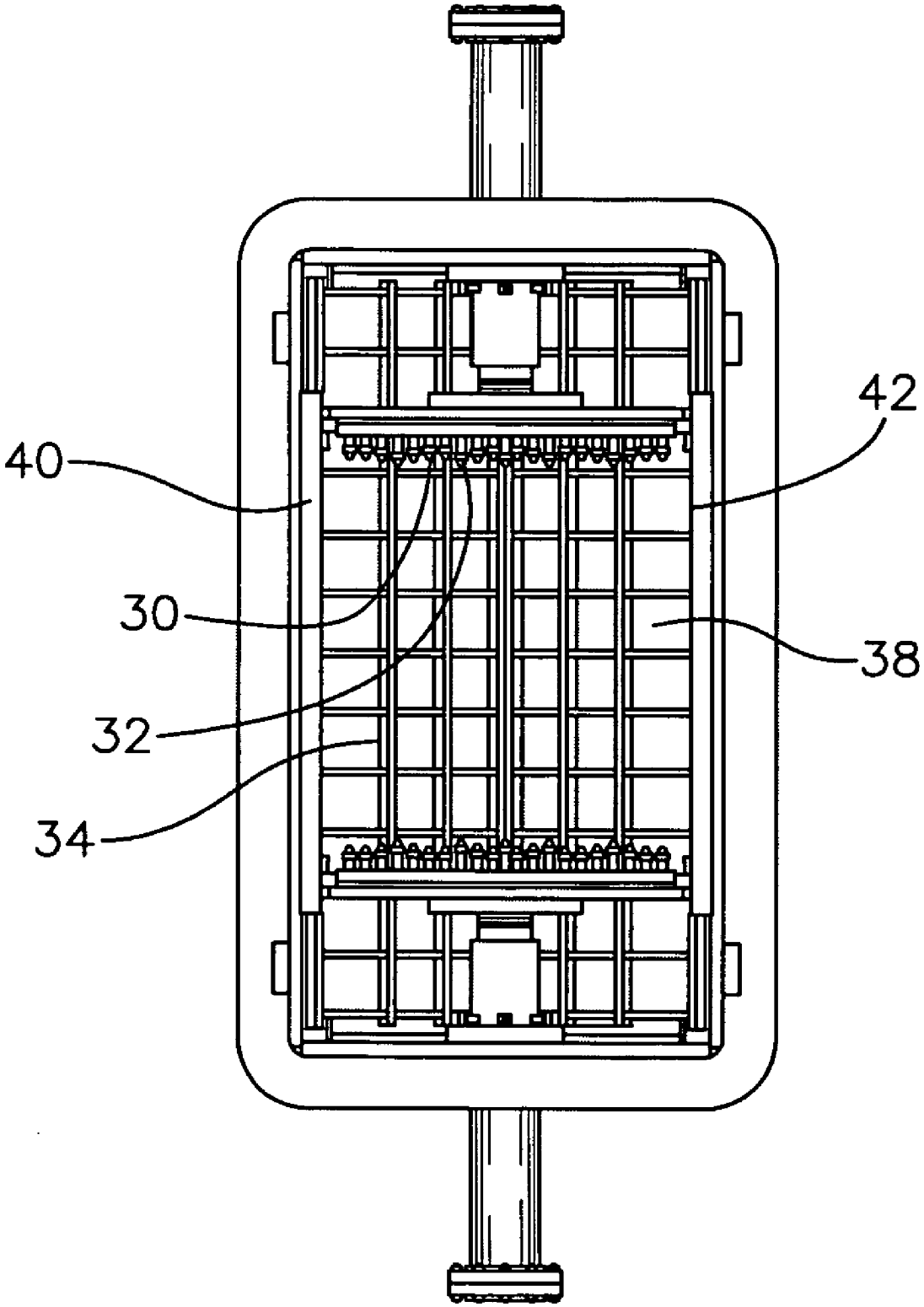
FIG. 2 is a top view of the apparatus of FIG. 1.
Figure 4:
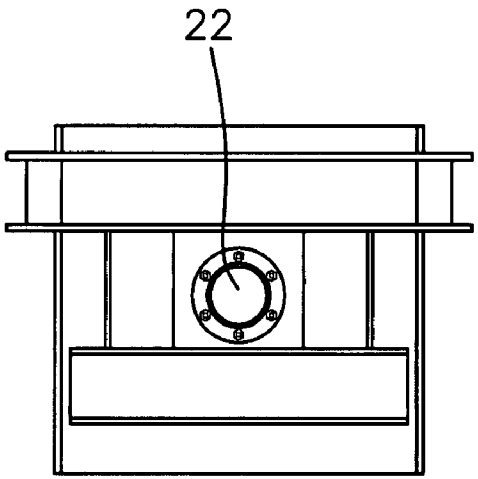
FIG. 4 is an end elevational view of the apparatus of FIG. 1.
Figure 3:
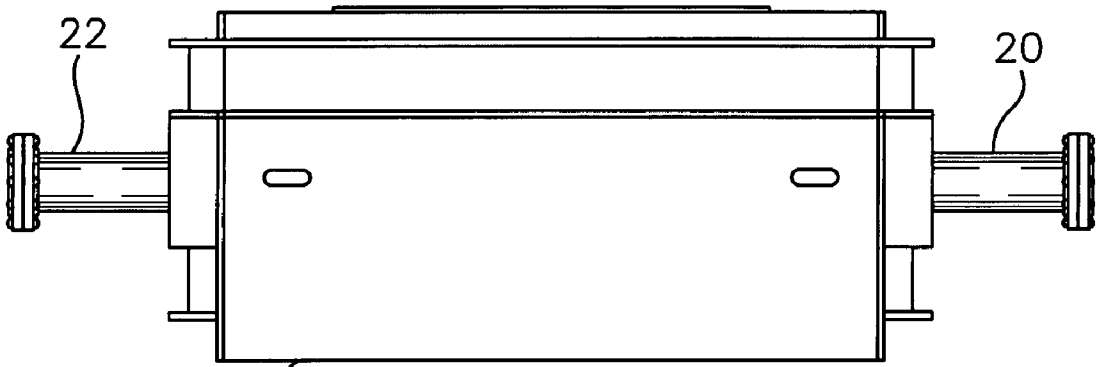
FIG. 3 is a side elevational view of the apparatus of FIG. 1.
Figure 5:
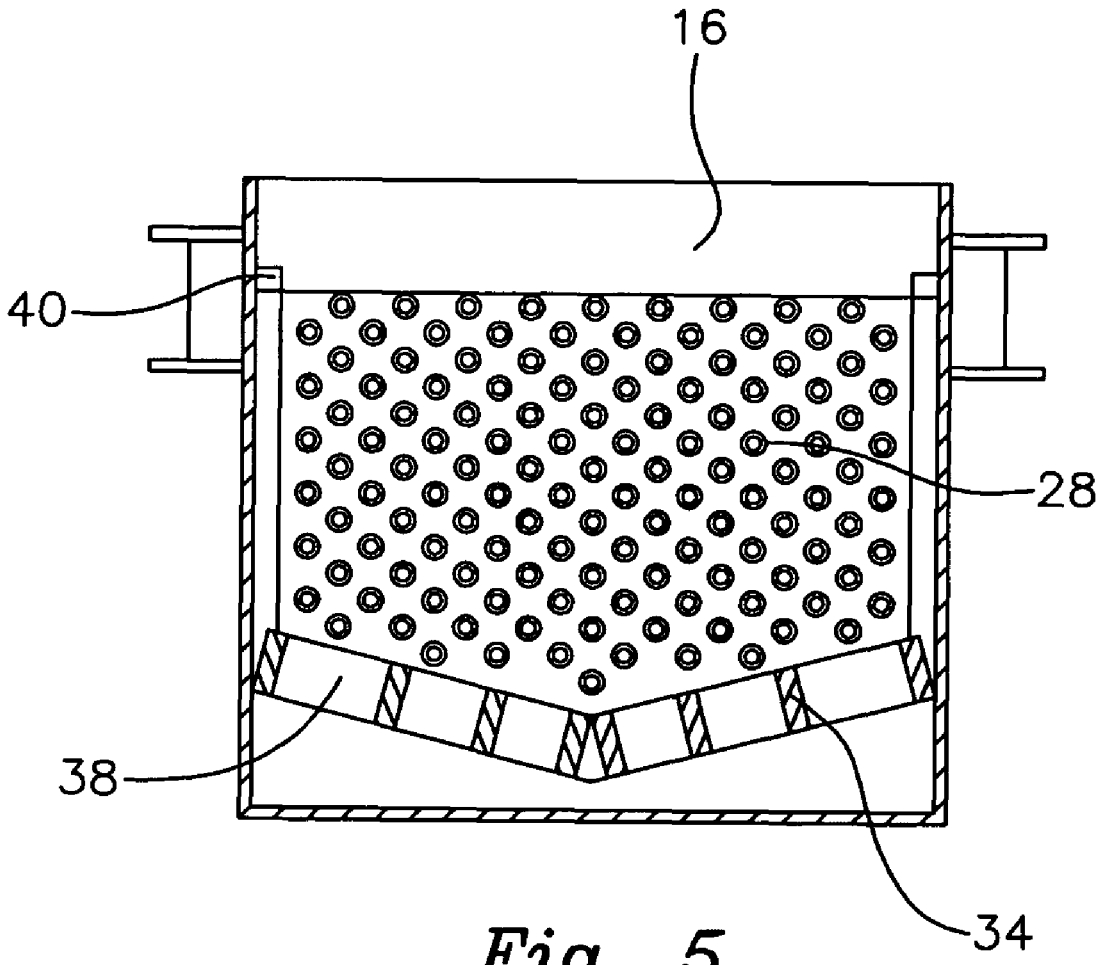
FIG. 5 is an end view of a portion of the apparatus of FIG. 1 with an end wall and a movable wall removed.

Crusher 10, as shown in FIG. 1, includes guides 40 and 42 having anti-wear strips. Guides 40 and 42 are located on each side of the center section of chamber 12 in the travel area of movable walls 16 and 18 and are adjacent to the tops of movable walls 16 and 18. The guides 40 and 42 are firmly attached to the chamber 12 for the purpose of holding the movable walls 16 and 18 down during travel that otherwise would potentially raise up out of the crushing zone above the grate 34. This allows the crusher 10 to maintain the desired dimensional tolerances between the movable walls 16 and 18 and the grate 34.

Figure 9:
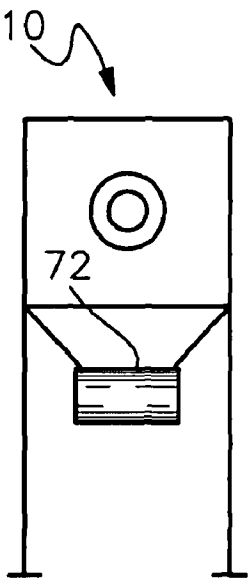
FIG. 9 is a front elevational view of one of the apparatus of FIG. 8.
Figure 8:
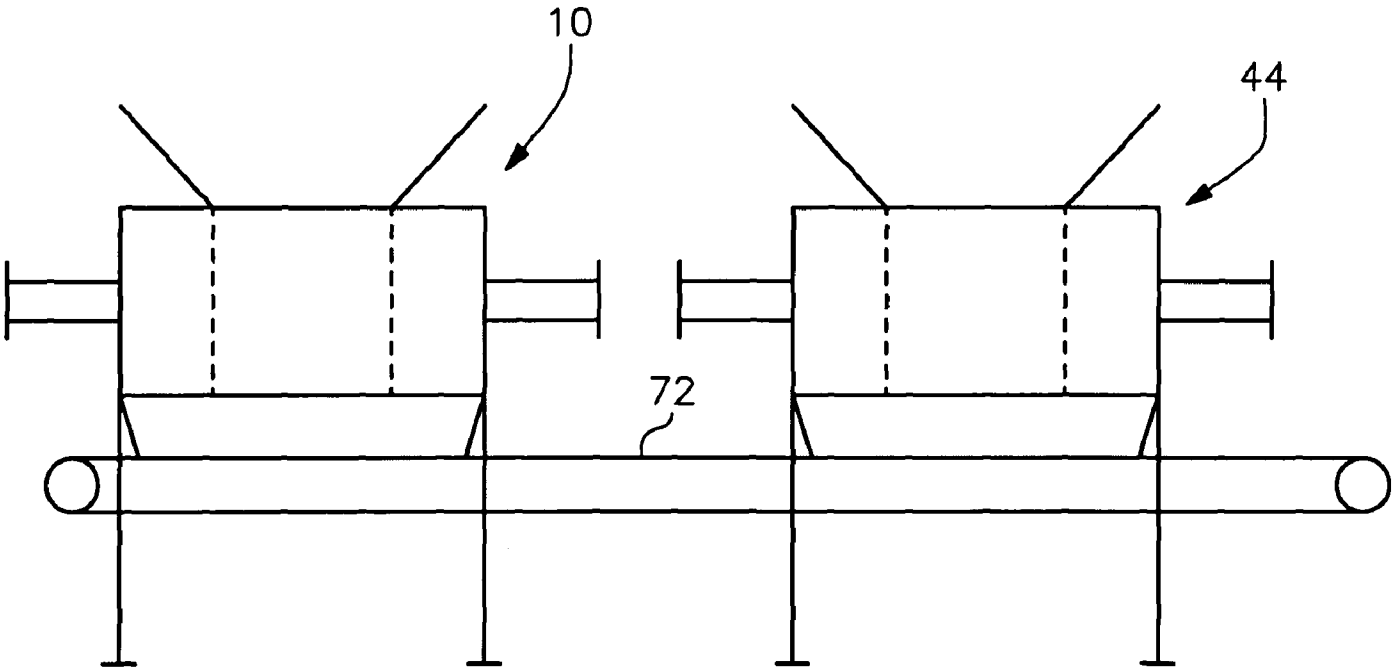
FIG. 8 is a side elevational view showing two of the apparatus of FIG. 1 set up for continuous operation.

The method and apparatus as described above is commonly termed a "batch" system in that there is a period of time when no size reduction is taking place, specifically while the crusher 10 is being fed before the process described in detail above takes place. A second identical unit 44, as shown in FIGS. 8 and 9, may be incorporated into this invention whereby one of the crushers 10 is performing the crushing operation while the second crusher 44 is being fed by a separate loading apparatus that could include any material transfer machine capable of elevating the feed minerals and dropping them into the chamber of the second crusher. A single power source no larger than the power source necessary to operate a single crusher alternately powers one, then the other unit to allow a "continuous" process as opposed to the "batch" process noted above.

Control of the two crushers 10 and 44 is accomplished by an attached push button control station which allows hydraulic fluid to be directed to the active apparatus while the alternate apparatus is on standby. When the "stop" button is pushed on either of the two devices, the fluid flow is transferred via valve to the apparatus which has the "start" button pushed, typically the alternate unit that has been loaded with feed material while the other apparatus finishes processing material in its chamber. The pressure relief system, flow measurement and control system, and the method of utilizing alternate chambers from a single power unit are all features of this invention.

By way of example and by no means intending to limit the applicability of the invention to a single mineral, the invention is utilized in crushing spent carbon anodes, such as anode piece 14 shown in FIG. 6, after an aluminum plant has used the carbon lumps in its manufacturing process. The spent anodes require size reduction for various alternative market needs as well as a need to isolate and segregate hard anodes and metals that are attached to or within the carbon lumps including but not limited to copper, iron, aluminum, and manganese all of which are separated post crushing by various means to make the recycled carbon as viable for other uses as possible. The invention has applications in other mineral industries as well and is notably effective due to the extremely low velocity compared to other crushing technologies, the low wear on the cutting devices and other mechanical components, the low horsepower required per ton per hour fed into the crusher, and the overall effective cost of operation factoring in all financial elements of a dual crusher box assemblies and common power pack component.

Figure 7:
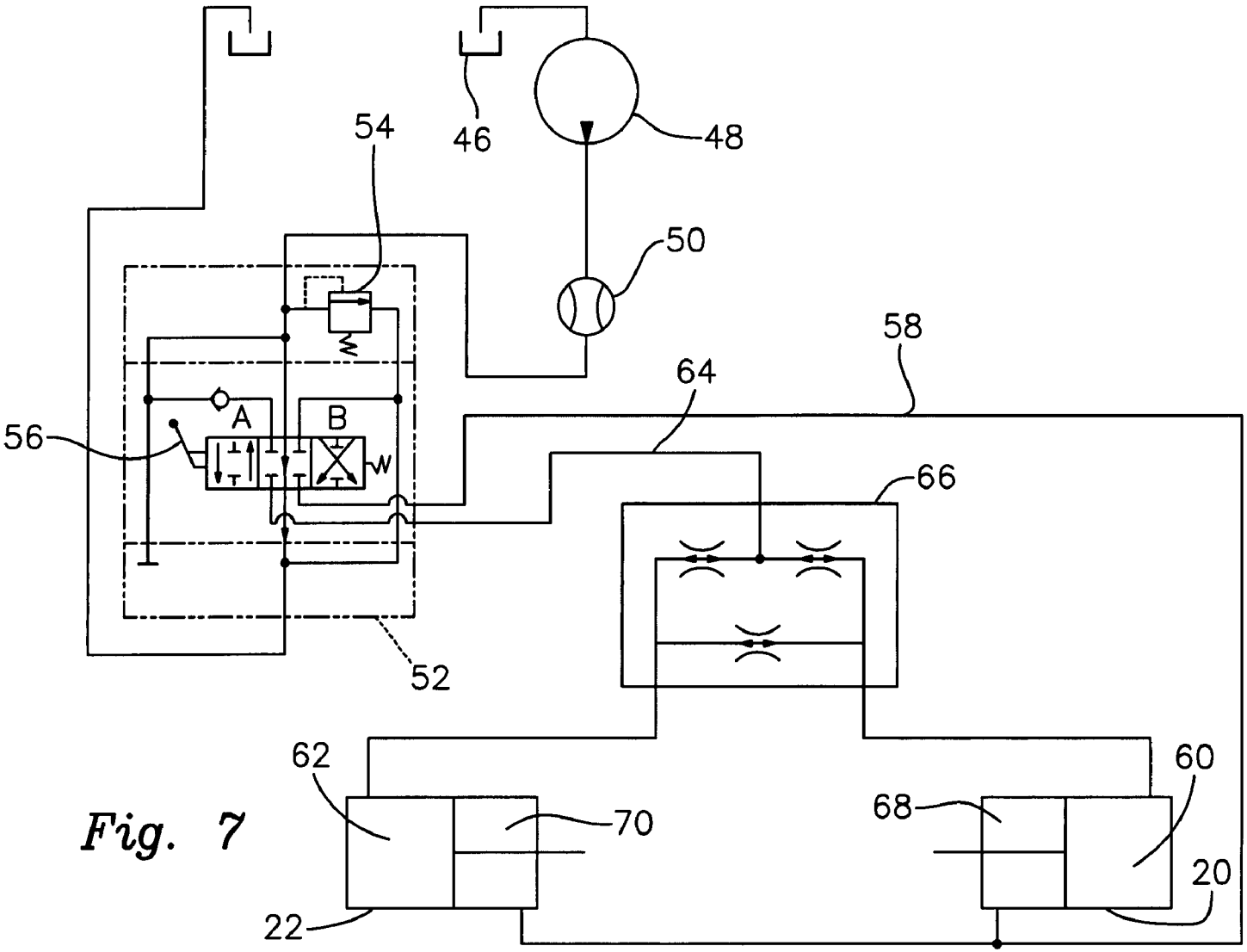
FIG. 7 is a schematic showing the hydraulic circuit used to operate the apparatus of FIG. 1.

FIG. 7 shows a hydraulic circuit which controls the operation of cylinders 20 and 22. Hydraulic fluid from reservoir 46 is pumped through pump 48 and through flow meter 50. The velocity of the hydraulic fluid through flow meter 50 is preset, preferably at fifty grams per meter (50 g/m) which is a very low velocity for the anode crusher industry. Thus, the velocity of the hydraulic fluid can not exceed a preset speed. The hydraulic fluid from the flow meter travels through VG35 valve 52. Valve 52 includes a pressure sensor 54 and a diverter. If the hydraulic pressure sensed by sensor 54 exceeds a predetermined amount, which should be set to the maximum amount required to crush a specific material such as soft carbon in a carbon anode, a warning light goes off. By using joy stick 56, an operator can reverse the flow of the hydraulic fluid to cylinders 20 and 22. That is, during normal operation hydraulic fluid will flow through hydraulic line 58 from valve 52 and into the normal operating sides 60 and 62 of cylinders of 20 and 22. However, when the operator reverses the flow by moving joy stick 56, hydraulic fluid will flow through hydraulic lines 64 through flow divider 66 and into the opposite sides 68 and 70 of cylinders 20 and 22 so that walls 16 and 18 to reverse direction, thereby ceasing the crushing operation. Typically, a high pressure will occur when some of the cutting devices 28 come into contact with a hard anode or uncrushable metal such as metal 24 shown in FIG. 6.

FIG. 8 shows the simultaneous use of two (2) crushers 10 and 44 so as to convert this assembly from a batch process to a continuous process. As stated previously, crusher 10 is loaded with anode material while crusher 44 is doing a crushing operation. Once the crushing operation in crusher 44 has been completed, crusher 10 begins its crushing operation and crusher 44 is loaded. The materials which fall from the bottom of crushers 10 and 44 drop to conveyor 72.

The apparatus and method of this invention provides minimal velocity compared to most prior art crushers, which minimizes wear and associated operating costs. Pressure is controllable based on the material to be crushed, thereby crushing the desired material and not crushing items such as commingled metal or hard anode material. The invention provides for less power consumption for a given throughput than most alternative crushing apparatus. Low velocity translates to low dust and to minimal fines generation, which is universally desired in crushing minerals.

From the foregoing description of the preferred embodiments of the invention, it will be apparent that many modifications may be made therein. It should be understood, however, that each of these embodiments of the invention are exemplifications of the invention only and that the invention is not limited thereto. It is to be understood, therefore, that it is intended in the appended claims to cover all modifications as fall within the true spirit and scope of the invention.

The invention claimed is:

1. An apparatus for crushing anodes and for recovering carbon from the anodes comprising:

a chamber for receiving anodes made primarily of carbon; at least some of the anodes being hard or having metal material embedded therein or associated therewith;

first and second vertical walls located at opposing ends of the chamber prior to crushing the anodes;

at least the first wall being a movable wall; the first wall having a plurality of cutting devices attached thereto; the first wall being able to move in a first direction toward the second wall for crushing the anodes received in the chamber and in a second direction away from the second wall and away from the anodes; the first wall remaining vertical while moving in the first direction and the second direction;

an apparatus for applying pressure to the first wall for moving the first wall in the first direction; at least one pressure sensor associated with the apparatus for applying pressure whereby when at least one of the cutting devices comes into contact with a hard anode or with metal material and a predetermined pressure level is exceeded, the first wall ceases moving in the first direction and begins moving in the second direction; and an apparatus for regulating the velocity of the first wall in the first direction.

2. An apparatus as set forth in claim 1 wherein the second wall is also movable.

3. An apparatus as set forth in claim 2 wherein the apparatus for applying pressure is a hydraulic system.

4. An apparatus as set forth in claim 3 wherein the hydraulic system includes a first cylinder associated with the first movable wall and a second cylinder associated with the second movable wall, hydraulic fluid associated with the first and second cylinders, and the sensor for sensing the pressure of the hydraulic fluid.

5. An apparatus as set forth in claim 4 wherein each cylinder has first and second sides; when hydraulic fluid pressure is below a predetermined level, hydraulic fluid flows into the first side of each cylinder wherein the movable walls are moved in the first direction and when hydraulic fluid pressure is at or above the predetermined level, hydraulic fluid flows into the second side of each cylinder wherein the movable walls are moved in the second direction.

6. An apparatus as set forth in claim 1 wherein the cutting devices are staggered teeth.

7. An apparatus as set forth in claim 1 wherein the pressure sensor is connected to an alarm.

8. An apparatus as set forth in claim 4 wherein the apparatus for regulating the velocity of the first wall also regulates the velocity of the second wall; the apparatus for regulating the velocity of the first and second walls including a flow meter for adjusting the flow rate of the hydraulic fluid whereby the velocity of the first and second movable walls may be controlled.

9. An apparatus as set forth in claim 3 further including an apparatus for adjusting hydraulic pressure.

10. An apparatus as set forth in claim 9 wherein the apparatus for adjusting hydraulic pressure is a bypass valve.

11. An apparatus as set forth in claim 1 wherein the chamber includes first and second guides; the first movable wall contacting the guides wherein the first movable wall is secured within the chamber.

12. An apparatus as set forth in claim 1, further including a second chamber for receiving anodes, at least one movable wall received in the second chamber; the movable wall in the second chamber having a plurality of cutting devices associated therewith; the movable wall in the second chamber being able to move in a first direction for crushing the anodes received in the second chamber and in a second direction away from the anodes; an apparatus for applying pressure to the movable wall in the second chamber for moving the movable wall in a first direction; at least one pressure sensor associated with the apparatus for applying pressure to the movable wall in the second chamber whereby when a predetermined pressure level is reached; the movable wall in the second chamber ceases movement in the first direction and begins moving in the second direction; each chamber having a bottom; a grate covering each bottom, each grate having a plurality of apertures therein for permitting pieces of the crushed anode to pass therethrough; and a conveyor located below the grates for receiving and conveying pieces of crushed anodes.

13. A method for crushing anodes and for recovering carbon from the anodes comprising:

placing anodes in a chamber having first and second vertical walls located at opposing ends of the chamber prior to crushing the anode, with at least the first wall being movable, and a bottom grate; the anodes being made primarily of carbon and at least some of the anodes being hard or having metal material embedded therein or associated therewith;

applying pressure to the first movable wall thereby moving the first wall towards the second wall and towards the anodes;

crushing the anodes with cutting devices attached to the first movable wall;

contacting a hard anode or metal material with at least one of the cutting devices;

sensing a pressure above a predetermined level when at least one of the cutting devices comes into contact with a hard anode or with metal material;

moving the first movable wall away from the second wall and away from the anodes in response to the pressure being above the predetermined level; the first wall remaining vertical while moving towards and away from the second wall; and regulating the velocity of the first wall.

14. A method as set forth in claim 13 wherein the second wall is also movable; applying pressure to the second movable wall thereby moving the second movable wall towards the first wall and towards the anodes; crushing the anodes with cutting devices attached to the second movable wall; sensing a pressure above a predetermined level; and moving the second movable wall away from the first movable wall and away from the anodes in response to the pressure being above the predetermined level.

15. A method as set forth in claim 14 wherein the pressure applied to the movable walls is provided hydraulically.

16. A method as set forth in claim 15 further including a first hydraulic cylinder associated with the first movable wall and a second hydraulic cylinder associated with the second movable wall, hydraulic fluid is associated with the first and second cylinders, and the pressure which is sensed being the pressure of the hydraulic fluid.

17. A method as set forth in claim 16 wherein each cylinder has first and second sides; when hydraulic fluid pressure is below a predetermined level, flowing fluid into the first side of each cylinder wherein the movable walls are moved toward the anodes and when the hydraulic fluid pressure is at or above the predetermined level, flowing fluid into the second side of each cylinder wherein the movable walls are moved away from the anodes.

18. A method as set forth in claim 13 wherein the cutting devices are staggered teeth.

19. A method as set forth in claim 13, further including initiating an alarm in response to sensing a pressure above a predetermined level.

20. A method as set forth in claim 16, further including adjusting the flow rate of hydraulic fluid whereby the velocity of the movable walls may be controlled.

21. A method as set forth in claim 16, further including adjusting the hydraulic fluid pressure.

22. A method as set forth in claim 21 wherein the hydraulic fluid pressure is adjusted by a bypass valve.

23. A method as set forth in claim 13 wherein the chamber includes first and second guides, and contacting the guides with the first movable wall wherein the first movable wall is secured within the chamber.

24. A method as set forth in claim 13, further including passing the crushed anodes through a grate in the bottom of the chamber, receiving the crushed anodes from the bottom of the chamber on a conveyor, and conveying the crushed anodes.

25. A method as set forth in claim 13, further including placing anodes in a second chamber while the anodes in the first chamber are being crushed, crushing the anodes in the second chamber after the crushing operation has ceased in the first chamber, and placing anodes in the first chamber while anodes are being crushed in the second chamber.

26. A method as set forth in claim 13, further including sensing a pressure below a predetermined level, and re-applying pressure to the first movable wall thereby moving the first wall toward the anodes in response to the pressure being below a predetermined level.

27. An apparatus as set forth in claim 1 wherein the first and second walls are substantially vertical and substantially parallel to each other.

28. A method as set forth in claim 13 wherein the first and second walls are substantially vertical and substantially parallel to each other.

29. An apparatus as set forth in claim 1 wherein the chamber includes a bottom; at least a portion of the bottom including a grate having a plurality of apertures of a predetermined size whereby the size of the crushed anode material which passes through the apertures is regulated.

30. An apparatus as set forth in claim 13, further including passing crushed anode material of a predetermined maximum size through apertures in a grate at the bottom of the chamber.

31. An apparatus for crushing anodes and for recovering carbon from the anodes comprising:

a chamber for receiving anodes made primarily of carbon; at least some of the anodes being hard or having metal material embedded therein or associated therewith;

first and second vertical walls located at opposing ends of the chamber prior to crushing the anodes;

at least the first wall being a movable wall; the first wall having a plurality of cutting devices attached thereto; the first wall being able to move in a first direction toward the second wall for crushing the anodes received in the chamber and in a second direction away from the second wall and away from the anodes; the first wall remaining vertical while moving in the first direction and the second direction;

an apparatus for applying pressure to the first wall for moving the first wall in the first direction; at least one pressure sensor associated with the apparatus for applying pressure whereby when at least one of the cutting devices comes into contact with a hard anode or with metal material and a predetermined pressure level is exceeded, the first wall ceases moving in the first direction and begins moving in the second direction;

the apparatus for applying pressure to the first wall being a hydraulic system including at least one hydraulic line containing hydraulic fluid; and a hydraulic fluid flow meter connected to the hydraulic line; the hydraulic fluid flow meter being preset so as to limit the velocity of the hydraulic fluid moving in the hydraulic line thereby limiting the velocity of the first wall.

32. An apparatus as set forth in claim 31 wherein the velocity of the hydraulic fluid is no greater than fifty grams per meter.

33. An apparatus as set forth in claim 31, further including a cylinder associated with the first wall; the cylinder having first and second sides; hydraulic fluid pressure being applied to the first side of the cylinder for moving the wall in the first direction; a flow diverter connected to the hydraulic line whereby when a predetermined pressure is exceeded, the hydraulic fluid flow may be reversed so as to apply hydraulic fluid pressure to the second side of the cylinder and for moving the first wall in the second direction.

* * * * *